US007699123B2

(12) United States Patent
Putnam

(10) Patent No.: US 7,699,123 B2
(45) Date of Patent: Apr. 20, 2010

(54) BORE HOLE SLEEVE REAMING APPARATUS AND METHOD

(76) Inventor: Samuel W. Putnam, 305 Darbonne Dr., West Monroe, LA (US) 71291

( * ) Notice: Subject to any disclaimer, the term of this patent is extended or adjusted under 35 U.S.C. 154(b) by 35 days.

(21) Appl. No.: 12/154,942

(22) Filed: May 28, 2008

(65) Prior Publication Data

US 2008/0296066 A1 Dec. 4, 2008

Related U.S. Application Data

(60) Provisional application No. 60/932,896, filed on Jun. 4, 2007.

(51) Int. Cl.
*E21B 7/28* (2006.01)
*E21D 1/06* (2006.01)

(52) U.S. Cl. ..... 175/53; 175/406

(58) Field of Classification Search ..... 175/53, 175/406; 405/184.2, 184.3
See application file for complete search history.

(56) References Cited

U.S. PATENT DOCUMENTS 5,522,467 A * 6/1996 Stevens et al. ..... 175/73
5,642,912 A 7/1997 Parish, II ..... 294/86.12
5,785,458 A 7/1998 Handford ..... 405/184
5,816,345 A * 10/1998 Keller ..... 175/53
6,098,708 A 8/2000 Jenne ..... 166/55.3
6,244,783 B1 6/2001 Puttmann et al. ..... 405/184
6,808,030 B2 10/2004 Klemm ..... 175/53
2005/0034896 A1 * 2/2005 Youan ..... 175/53

* cited by examiner

*Primary Examiner*—William P Neuder
(74) *Attorney, Agent, or Firm*—John M. Harrison

(57) ABSTRACT

A bore hole sleeve reaming apparatus which is characterized by one or more subterranean bore clearing devices or sleeves for use with one or more clearing or bursting heads attached to a pull rod or cable and a pulling apparatus. One or more tapered sleeves are attached in spaced-apart relationship to a string of tandem-mounted plastic pipe when the clearing or bursting head or heads are attached to the pipe string to be pulled through the bore hole. The tapered sleeves are designed to straighten bore irregularities and clean, smooth and free the bore hole from collapsing earth, roots and/or rock and broken pipe and facilitate pulling the pipe string through the bore hole with minimum friction on the pipe string. The clearing sleeve elements are sequentially pulled through the bore hole with the clearing or bursting head(s) and pipe string from an entry pit using a pull rod or cable and a pulling apparatus is seated in a corresponding exit pit spaced from the entry pit and receives the opposite end of the pull rod or cable. A method for clearing and cleaning a subterranean pilot bore or tunnel is also disclosed.

14 Claims, 3 Drawing Sheets

BORE HOLE SLEEVE REAMING APPARATUS AND METHOD

CROSS-REFERENCE TO RELATED APPLICATIONS

This application claims the benefit of and incorporates by reference prior filed U.S. Provisional Application Ser. No. 60/932,896, filed Jun. 4, 2007.

BACKGROUND OF THE INVENTION

Summary of the Invention

This invention relates to trenchless technology for placing a pipe string such as welded lengths of high density polyethylene (HDPE) pipe in a bored path and more particularly, to a bore hole sleeve reaming or clearing apparatus and method for enlarging, clearing, smoothing and cleaning a pre-bored pilot hole, tunnel or pipe in a selected length of terrain between an entry pit and an exit pit. In one embodiment the bore hole sleeve reaming apparatus is characterized by one or more pipe bursting or clearing heads fitted with at least one tapered cleaning, scraping and/or bore hole clearing sleeve, wherein the bursting or clearing head is attached to a string of typically HDPE pipe pulled by a bursting head pulling apparatus using a pull rod or cable. The rod or cable extends through an undersized pre-bored hole or opening, typically drilled on grade and on line from an entry pit to a pulling apparatus connected to the opposite end of the pull rod in an exit pit. Alternatively, the bursting head can be used in the apparatus to break up and replace an existing pipe and the clearing sleeve or sleeves then operate to clear and clean the new bore. Accordingly, under circumstances where all or part of the resulting bore hole is subject to collapse or size reduction due to soil, root, rock, concrete fragments and other debris encroachment after passage of the bursting or clearing head reaming apparatus, the tapered clearing sleeve or sleeves attached to the plastic pipe string as a component of the reaming apparatus serve to clear the bore hole of these elements and thus reduce friction on the pipe string as it is pulled through the bore hole. The entire tandem bursting or clearing head and tapered sleeve pipe train traverses the bore hole path and the typically spaced-apart, tapered and clearing sleeves typically have longitudinal slots and are designed to clear soil and debris, as well as water and mud collapsing into the bore hole, which material would normally engage the pipe and promote excessive tensile strain due to friction on the pipe, causing the welded plastic pipe string to stretch and sometimes fail in a conventional pipe-pulling operation. Accordingly, the apparatus can be used under circumstances where the bore hole or any portion or run thereof extending between the entry pit and the exit pit is unstable and/or contains mud, water, concrete fragments or other debris and is thus subject to soil and other material infiltration, caving or collapse and constitutes a frictional hazard to pulling of the pipe directly therethrough. A typical bore hole sleeve reaming apparatus for pulling a pipe string through such a bore opening pipe or tunnel includes a lead bursting or clearing head or heads attached to a pull rod or cable lying adjacent to the bore hole opening in the entry pit. A length or string of typically HDPE or other plastic pipe is also connected to the clearing or bursting head, such that the tandem train is pulled through the bore at the entry pit by a pulling apparatus located in an exit pit spaced-apart from the entry pit. According to this invention, the pipe train is provided with at least one, and preferably several, spaced-apart, typically HDPE clearing sleeves that are tapered at the front end and typically slotted longitudinally and welded to, or otherwise securely seated on the pipe string. The pulling apparatus is operated to advance the pull rod and the bore hole sleeve reaming apparatus with the clearing sleeves on the pipe string through the bore, thus enlarging, clearing, drying and smoothing the bore and facilitating a more smooth and straight path for pulling or laying the pipe in an environment of minimum friction, "floating" and tensile load on the pipe string. While substantially any pulling apparatus which is capable of generating at least about 200,000 pounds of pulling power can be located in the exit pit and coupled to the bore hole reaming apparatus, in one embodiment of the invention the pulling apparatus detailed in my U.S. Pat. No. 7,025,536 may be used as a component of the bore hole sleeve reaming apparatus of this invention for the task.

BRIEF DESCRIPTION OF THE DRAWINGS

The invention will be better understood by reference to the accompanying drawings, wherein.

DESCRIPTION OF THE PREFERRED EMBODIMENTS

Figure 1:
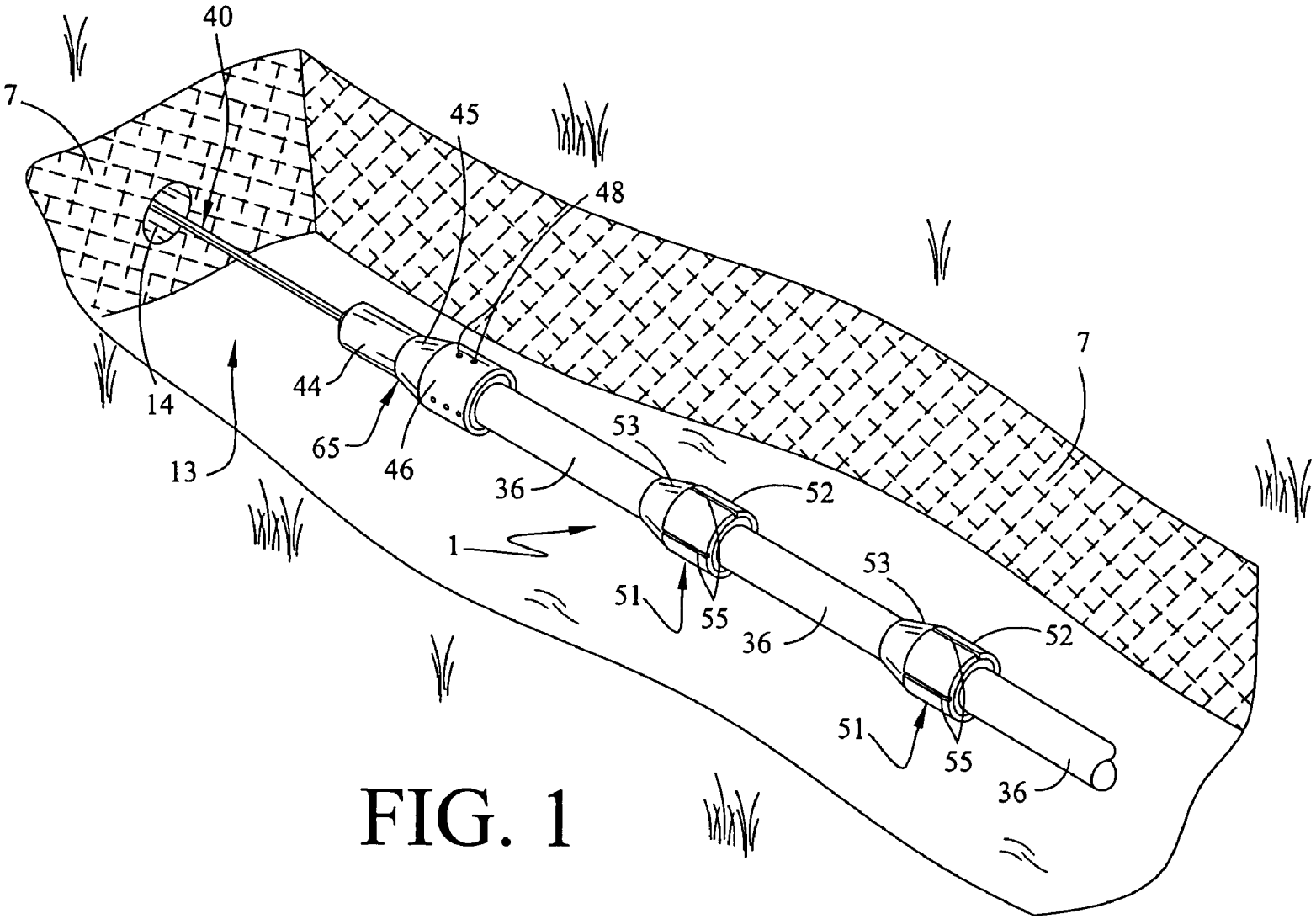
FIG. 1 is a perspective view of a typical bore hole sleeve reaming apparatus, which includes in tandem, a cleaning or bursting head attached to a length or string of pipe to be pulled through a previously bored opening or a pipe to be burst and a pair of front-tapered clearing sleeves typically welded to a segment of the pipe string for clearing the new bore of soil, mud, water, roots, rocks, concrete fragments and other encroaching material.
Figure 2:
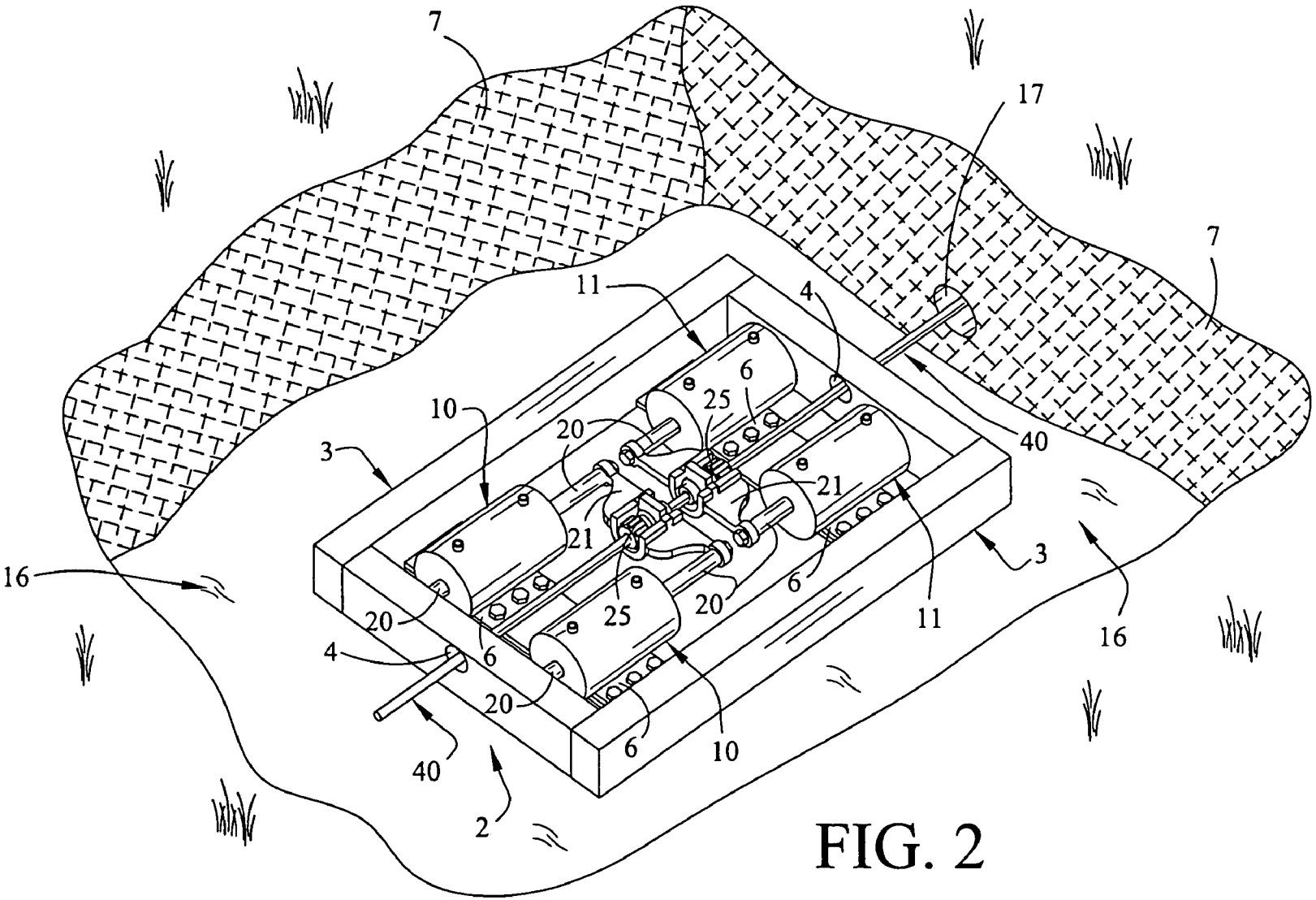
FIG. 2 is a perspective view of a typical pulling apparatus located in an exit pit spaced-apart from the entry pit which receives the bore hole reaming apparatus, for advancing a pull rod or cable through the bore hole or pipe along with the bore hole sleeve reaming apparatus.
Figure 5:
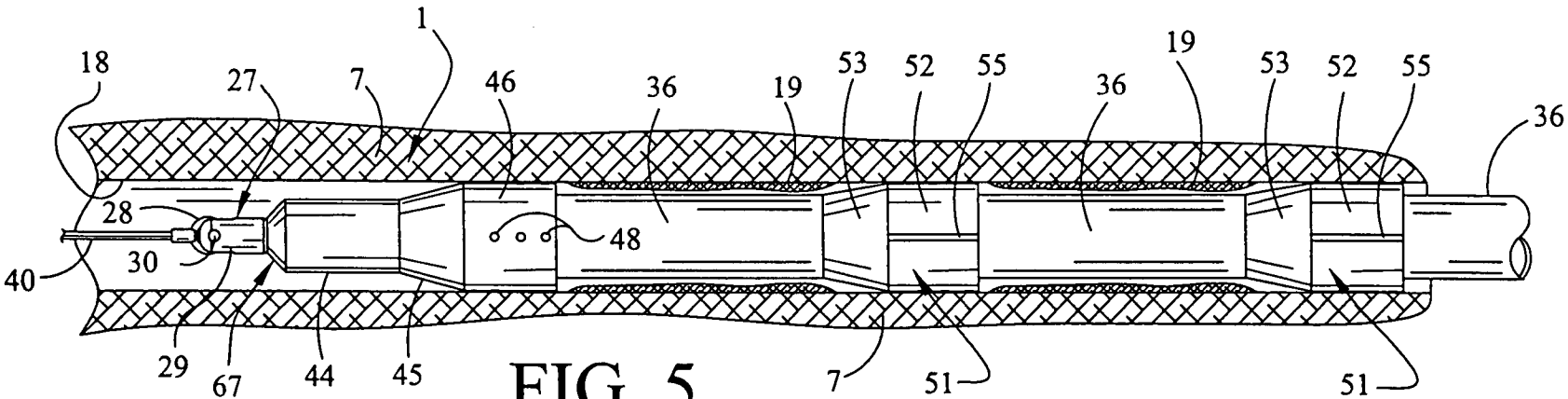
FIG. 5 is a side sectional view of the cleaning or bursting head in the tandem apparatus illustrated in FIG. 1, carrying a length of typically welded HDPE pipe, fitted with a pair of the spaced-apart, tapered clearing sleeves and positioned in a bore hole.

Referring initially to FIGS. 1, 2 and 5 of the drawings, in one embodiment of the invention a bore hole sleeve reaming apparatus is generally illustrated by reference numeral 1 (FIG. 1). The bore hole sleeve reaming apparatus 1 is typically oriented in an entry pit 13 with the respective elements of the apparatus aligned in tandem relationship, as further illustrated in FIG. 1. A clearing or bursting head 65 is connected to one end of a pull rod 40, the other end of which extends through the entry pit bore 14 and traverses a linear bore 18 (FIG. 5) and exit bore 17, to an exit pit 16, spaced a selected distance from the entry pit 13 and including a pulling apparatus 2 (FIG. 2). The pulling apparatus 2 receives the opposite end of the pull rod 40 and is designed to advance the pull rod 40 through the entry pit bore 14 and into the exit pit bore 17 and pull the bore hole sleeve reaming apparatus 1 and a pipe string 36 of selected length from the entry pit 13 to the exit pit 16. The pipe string 36 is fitted with a pair of clearing sleeves 51, as hereinafter further described.

The pulling apparatus 2 can be of any desired design, but as further illustrated in FIG. 2, is typically characterized by a frame 3, having pull rod openings 4 in opposite ends for receiving the pull rod 40 and fitted with a pair of rear rod driving members 10 and front rod driving members 11 (typically hydraulic cylinders), each having a piston rod 20, respectively, positioned in paired, facing relationship. A rod yoke 21 connects each of the respective pairs of piston rods 20 and a gripping element 25 is provided on each of the rod yokes 21, which gripping elements 25 are linearly aligned to receive and alternately grip the pull rod 40, as further illustrated in FIG. 2. The rear driving rod members 10 and front rod driving members 11 are typically mounted on corresponding mount plates 6, fixed to the frame 3 and the frame 3 is so situated in the exit pit 16 that hydraulic operation of the rear rod driving members 10 and front rod driving members 11 and the gripping elements 25 in sequence, advances the pull rod 40 through the pull rod openings 4 in the frame 3 and through the exit pit bore 17 and the exit pit 16, with significant pulling force.

Figure 4:
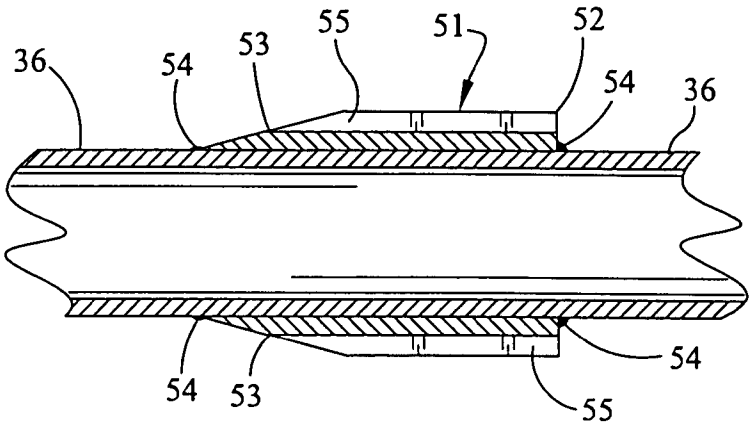
FIG. 4 is a longitudinal sectional view of the tapered clearing sleeve illustrated in FIG. 3, more particularly illustrating typical front and rear welds for mounting the clearing sleeve on the pipe string.
Figure 3:
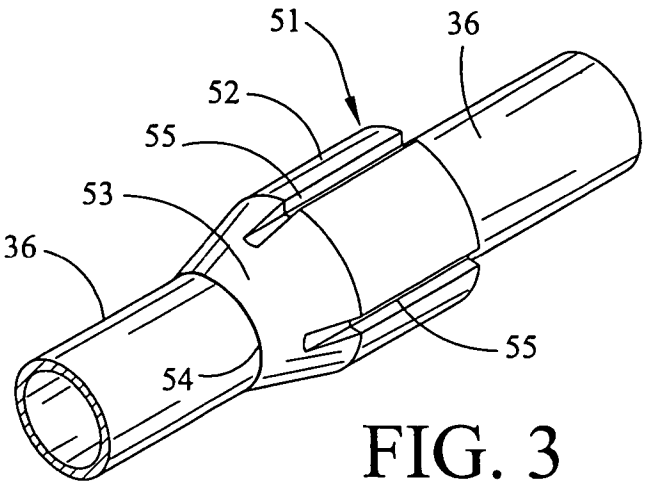
FIG. 3 is a perspective view of a section of HDPE pipe with a typical tapered and slotted cleaning sleeve welded thereon.

Referring now to FIGS. 1, 3 and 4 of the drawings, the opposite end of the pull rod 40 from the pulling end extends through the entry pit bore 14 of the entry pit 13 as described above, and is typically connected to the bursting head 65 in any desired fashion, according to the knowledge of those skilled in the art. A typical connection is by use of a clevis coupling 28 and clevis pin 30, as illustrated in FIG. 5. A length of typically HDPE pipe string 36 is attached to the bursting head 65, typically by pipe mount bolts 48 (FIG. 5) for sequentially pulling the pipe string 36 through the entry pit bore 14 in the entry pit 13 (FIG. 1). A pair of typically plastic clearing sleeves 51, each having a cylindrical, hollow sleeve body 52, is seated in spaced-apart relationship with respect to each other on the pipe string 36. The clearing sleeves 51 are tapered at the leading end at a sleeve taper 53 and are typically secured at a sleeve weld or welds 54 (FIG. 4), but may be tightly slip-fitted on selected ones of the pipe elements of the pipe string 36 and seated against the pipe welds (not illustrated) which secure the pipe elements together in tandem string. In a preferred embodiment the sleeve body 52 and sleeve taper 53 of the clearing sleeves 51 are fitted with at least one, and preferably multiple radially spaced-apart, longitudinal sleeve slots 55 for channeling water and mud in the linear bore 18.

It will be appreciated by those skilled in the art that while the bore hole sleeve reaming apparatus 1 is illustrated in FIG. 1 in a complete, "made up" configuration in the entry pit 13, in a typical application, the clearing or bursting head 65 is initially attached to the projecting end of the pull rod 40, typically as heretofore described. The bursting head 65 is then pulled partially into the entry pit bore 14 by operation of the pulling apparatus 2 illustrated in FIG. 2, which is operated according to the procedure outlined in my U.S. Pat. No. 7,025,536. The cleaning or bursting head 65 is then secured to the string of pipe string 36, typically using pipe mount bolts 48. The pulling apparatus 2 is again operated to pull the cleaning or bursting head 65 and the pipe string 36, fitted with the clearing sleeves 51, sequentially through the entry bore 14 until the pipe string 36 is located in the enlarged, but typically debris-cluttered, linear bore 18 without excessive room for "floating", as illustrated in FIGS. 3-5 of the drawings.

Under circumstances where the linear bore 18 includes particulate matter and debris clutter such as loose soil, water, mud, rocks, roots and concrete particles or fragments and the like, illustrated in FIG. 5 as bore encroachment material 19, that have collapsed or encroached into the linear bore 18 after the linear bore 18 was enlarged, then the respective spaced-apart clearing sleeves 51 serve to smooth and clean the bore hole and help maintain the linear bore 18 free of the encroachment material 19. This action facilitates pulling the string of pipe string 36 through the linear bore 18 with a minimum of friction, causing little or no damage to the pipe string 36. Since the pipe string 36 is typically made up of welded HDPE pipe segments or lengths of selected wall thickness, it is highly advantageous to create an enlarged and clear linear bore 18 which is relatively straight, clean and smooth, to allow smooth movement of the pipe string 36 therethrough with minimum friction and linear tension. The linear bore 18 should also snugly encase the pipe to prevent "floating" or misalignment of the pipe due to an excessively large bore. Accordingly, the bore hole sleeve reaming apparatus 1 serves to straighten out minor bore irregularities and smooth and enlarge the linear bore 18 by removing debris from the bore and depositing it in the exit pit 16, to prepare and smooth the way for the pipe string 36. The clearing sleeves 51 also serve to move fluid mud and water rearwardly through the sleeve slots 55 and push accumulated hard mud, clay and debris that is not forced into the bore wall forwardly, to further reduce friction on the pipe string 36.

Referring again to FIGS. 1 and 3 of the drawings, the cleaning or bursting head 65 is typically characterized by a cylindrical bursting head housing 44, having a tapered housing expander 45 that extends from the bursting head housing 44 to the pipe mount cylinder 46. Multiple, radially-oriented and aligned mount screw or bolt openings (not illustrated) are typically provided in each of the pipe mount cylinders 46 to receive corresponding pipe mount bolts 48 (FIGS. 1 and 5) and facilitate connecting these elements of the apparatus to a pipe string 36, as deemed necessary.

It will be appreciated by those skilled in the art that the embodiments of the bore hole sleeve reaming apparatus 1 and the individual clearing sleeves 51 of this invention provide a versatile and effective technique for pulling a length of pipe, and plastic pipe in particular, through a pre-bored, usually slightly undersized opening or hole or an existing pipe to be broken and replaced, in a terrain for selected distances, using a pulling apparatus of selected design. The apparatus is versatile, in that a selected number of cleaning or bursting heads 65 can be utilized and placed in single or tandem, articulating fashion in the manner described above, to cooperate with the clearing sleeves 51 and enlarge, smooth and clear the linear bore 18 which enlarged the pre-drill bore hole, or break an existing pipe and facilitate passage and seating of the pipe string 36 in the resulting linear bore 18. The clearing sleeves 51 facilitate minimum friction applied to the pipe during the pulling operation and the operation can be effected without the necessity of digging a trench to lay the pipe, with only the requirement of an entry pit and exit pit for housing the apparatus and the pulling device, respectively. Referring again to the drawings, it will be appreciated that selection of the diameter of the clearing sleeves 51 to be used is determined by the diameter of the pipe string 36 to which it is attached and this sleeve diameter is always larger than the pipe diameter, to facilitate the bore-clearing operation described above.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A bore hole sleeve reaming apparatus for enlarging and cleaning a bore hole having an entrance end and an exit end and pulling a string of pipe through the bore hole, said bore hole sleeve reaming apparatus comprising at least one cleaning or bursting head provided at the entrance end of the bore hole for receiving the string of pipe; a connecting member having one end connected to said bursting head and the opposite end of said connecting member extending through the bore hole to the exit end of the bore hole; at least one tapered clearing sleeve provided on the string of pipe, said clearing sleeve having a diameter larger than the pipe; and a pulling apparatus connected to said opposite end of said connecting member at the exit end of the bore hole for pulling said bursting head, the string of pipe and said clearing sleeve from the entrance end of the bore hole through the bore hole to the exit end of the bore hole responsive to operation of said pulling apparatus.

2. The bore hole sleeve reaming apparatus of claim 1 wherein said at least one tapered clearing sleeve comprises a plurality of tapered clearing sleeves provided in spaced-apart relationship with respect to each other on the string of pipe.

3. The bore hole sleeve reaming apparatus of claim 1 wherein:

said at least one tapered clearing sleeve comprises a plurality of tapered clearing sleeves provided in spaced-apart relationship with respect to each other on the string of pipe.

4. The bore hole sleeve reaming apparatus of claim 1 wherein said connecting member comprises a rod.

5. The bore hole sleeve reaming apparatus of claim 1 wherein said connecting member comprises a cable.

6. The bore hole sleeve reaming apparatus of claim 1 comprising at least one longitudinal slot provided on said tapered clearing sleeve.

7. The bore hole sleeve reaming apparatus of claim 6 wherein:

said at least one tapered clearing sleeve comprises a plurality of tapered clearing sleeves provided in spaced-apart relationship with respect to each other on the string of pipe.

8. The bore hole sleeve reaming apparatus of claim 7 wherein said connecting member comprises a rod.

9. The bore hole sleeve reaming apparatus of claim 7 wherein said connecting member comprises a cable.

10. A method of enlarging, cleaning and straightening a bore hole having an entrance end and an exit end and pulling a pipe string through the bore hole using a pulling apparatus located at he exit end of the bore hole, comprising the steps of:

(a) extending a pull rod or cable through the bore hole, wherein one end of the pull rod or cable projects from the entrance end of the bore hole and the opposite end of the pull rod projects from the exit end of the bore hole and said opposite end of the pull rod is connected to the pulling apparatus;

(b) mounting at least one clearing sleeve having a diameter larger than the pipe string on the pipe string; and (c) connecting at least one cleaning or bursting head adapted for receiving the pipe string to said one end of said pull rod or cable and pulling the bursting or cleaning head, the string of pipe and the clearing sleeve through the bore hole from the entrance end to the exit end responsive to operation of the pulling apparatus.

11. The method according to claim 10 comprising the step of providing at least one longitudinal slot in said clearing sleeve.

12. The method according to claim 10 comprising the step of tapering the end of the clearing sleeve closest to the cleaning or bursting head.

13. The method according to claim 10 comprising the steps of:

(a) providing longitudinal slots in said clearing sleeve; and (b) tapering the end of the clearing sleeve closest to the cleaning or bursting head.

14. The method according to claim 10 comprising the step of providing a plurality of slots in said clearing sleeve.

* * * * *